US009163635B2

(12) United States Patent
Chiu et al.

(10) Patent No.: US 9,163,635 B2
(45) Date of Patent: Oct. 20, 2015

(54) ELECTRIC FLUID PUMP

(75) Inventors: Arthur Chiu, Tainan (TW); Triven Lin, Tainan (TW); James Chien, Taichung (TW)

(73) Assignee: JI-EE INDUSTRY CO., LTD., Tainan (TW)

( * ) Notice: Subject to any disclaimer, the term of this patent is extended or adjusted under 35 U.S.C. 154(b) by 530 days.

(21) Appl. No.: 13/616,923

(22) Filed: Sep. 14, 2012

(65) Prior Publication Data

US 2013/0302142 A1 Nov. 14, 2013

(30) Foreign Application Priority Data

May 10, 2012 (TW) ..... 101116686 A

(51) Int. Cl.
*F04D 13/06* (2006.01)
*F04D 29/06* (2006.01)
*F04D 29/58* (2006.01)

(52) U.S. Cl.
CPC ..... *F04D 13/0606* (2013.01); *F04D 29/061* (2013.01); *F04D 29/5806* (2013.01)

(58) Field of Classification Search
CPC ..... F04D 13/0646
USPC ..... 417/366, 370
See application file for complete search history.

(56) References Cited

U.S. PATENT DOCUMENTS 3,220,350 A * 11/1965 White ..... 417/357
5,017,087 A * 5/1991 Sneddon ..... 415/72
5,624,244 A * 4/1997 Moon ..... 417/366
5,997,261 A 12/1999 Kershaw et al.
6,045,326 A * 4/2000 Lecat ..... 415/206

* cited by examiner

*Primary Examiner* — Dwayne J White
*Assistant Examiner* — Justin Seabe
(74) *Attorney, Agent, or Firm* — Locke Lord LLP

(57) ABSTRACT

An electric water pump includes a housing, a propelling mechanism disposed in the housing, and a driving mechanism for driving a driving shaft of the propelling mechanism. The driving shaft has a fluid passage in fluid communication with an impeller chamber and a cooling chamber in the housing. The propelling mechanism further includes a spiral rod disposed in the fluid passage and co-rotatable with the driving shaft, and an impeller disposed in the impeller chamber. During operation of the propelling mechanism, the impeller drives flow of a fluid, and the spiral rod co-rotates with the driving shaft to change the rate of the fluid flowing through the driving shaft.

6 Claims, 9 Drawing Sheets

ELECTRIC FLUID PUMP

CROSS-REFERENCE TO RELATED APPLICATION

This application claims priority of Taiwanese Application No. 101116686, filed on May 10, 2012.

BACKGROUND OF THE INVENTION

1. Field of the Invention

This invention relates to a fluid pump, and more particularly to an electric fluid pump having a cooling system.

2. Description of the Related Art

Referring to FIG. 1, an electric water pump 1 disclosed in U.S. Pat. No. 5,997,261 includes a housing 11. The housing 11 includes a hollow outer housing wall 111, and a partition unit 112 disposed in the outer housing wall 111 and cooperating with the outer housing wall 111 to define an impeller chamber 114, a mounting chamber 115, a cooling chamber 116, a cooling passage 117, and a stator chamber 118 disposed around the cooling chamber 116. The cooling passage 117 is disposed between and in fluid communication with the impeller chamber 114 and the cooling chamber 116.

The electric water pump 1 further includes an impeller 12 disposed in the impeller chamber 114 in the housing 11, a rotor 13 disposed in the cooling chamber 116, a driving shaft 14 co-rotatable with the impeller 12 and the rotor 13, a stator 15 disposed in the stator chamber 118 and aligned with the rotor 13, and an electric control unit 16 disposed in the mounting chamber 115 and electrically connected to the stator 15. The driving shaft 14 has a fluid passage 141 disposed between and in fluid communication with the cooling chamber 116 and the impeller chamber 114.

When the rotor 13 is rotated through operation of the electric control unit 16 to drive rotation of the driving shaft 14 and the impeller 12, a fluid is forced into the impeller chamber 114 through an inlet 119. A major portion of the fluid passes through the impeller chamber 114 along a delivery direction, and is discharged through an outlet 110. A minor portion of the fluid flows through the cooling passage 117 and into the cooling chamber 116. Since the pressure of the fluid located adjacent to the central portion of the impeller 12 is smaller than that of the fluid located adjacent to the circumferential portion of the impeller 12 when the impeller 12 rotates, the fluid returns from the cooling chamber 116 into the impeller chamber 114 through the fluid passage 141 in the driving shaft 14. As a consequence, the fluid flowing into the cooling passage 117 can returns to the impeller chamber 114 through the cooling chamber 116, thereby dissipating heat from the rotor 13, the stator 15, and the electric control unit 16.

The aforesaid electric water pump has a disadvantage. That is, the rate of the fluid flowing through the fluid passage 141 in the driving shaft 14 cannot be changed.

When a change of the cooling effect is desired, it is necessary to adjust the cross-sectional area of the cooling passage 117, thereby resulting in difficulties in manufacture and design. Furthermore, since the minor portion of the fluid flows into the cooling passage 117, when a change of the fluid pressure at the outlet 110 (i.e., output fluid pressure) is desired, it is also necessary to adjust the cross sectional area of the cooling passage 117.

SUMMARY OF THE INVENTION

The object of this invention is to provide an electric fluid pump, in which the cooling effect or output fluid pressure can be adjusted without changing the basic structure or the specification, thereby resulting in convenience during use.

According to this invention, an electric fluid pump comprises:

a housing including an outer housing wall and a partition unit cooperating with the outer housing wall so as to define an impeller chamber, a cooling chamber, and a cooling passage disposed between and in fluid communication with the impeller chamber and the cooling chamber;

a propelling mechanism including a driving shaft disposed rotatably on the partition unit of the housing and having a fluid passage formed therethrough, an impeller disposed in the impeller chamber and connected to and co-rotatable with the driving shaft, and a spiral rod disposed in the fluid passage in the driving shaft and co-rotatable with the driving shaft, the fluid passage being disposed between and in fluid communication with the impeller chamber and the cooling chamber in the housing; and a driving mechanism for driving rotation of the driving shaft of the propelling mechanism;

wherein, when the driving shaft is rotated by the driving mechanism, the impeller rotates to drive a fluid to pass through the impeller chamber along a delivery direction, and the spiral rod rotates to change the rate of the fluid flowing through the fluid passage in the driving shaft.

As such, by replacing the spiral rod with a new one having a different structure (e.g. different in the number of the spiral vanes or the spiral direction), the cooling effect or the output fluid pressure can be changed without any change of the basic structure and the specification.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
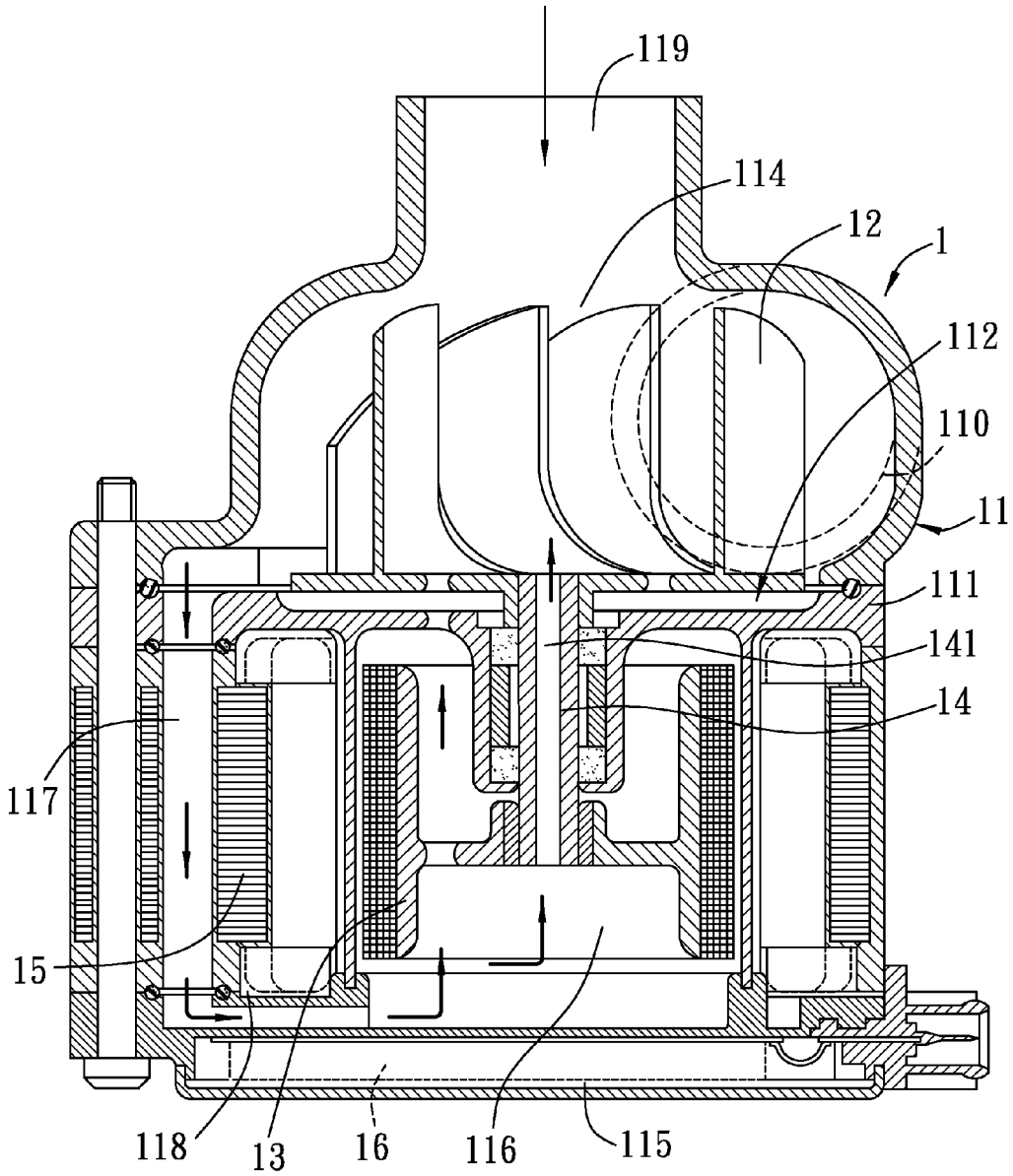
FIG. 1 PRIOR ART
FIG. 1 is a sectional view of a conventional electric water pump 1 disclosed in U.S. Pat. No. 5,997,261.

Before the present invention is described in greater detail in connection with the preferred embodiments, it should be noted that similar elements and structures are designated by like reference numerals throughout the entire disclosure.

FIGS. 2 to 5, the first preferred embodiment of an electric fluid pump according to this invention is adapted for driving a fluid to flow along a delivery direction 29. The electric fluid pump includes a housing 2, a propelling mechanism 3, and a driving mechanism 4, which are disposed within the housing 2.

The housing 2 includes a housing body 201, a first end cap 202, and a second end cap 203, which are assembled respectively to two opposite sides of the housing body 201. After assembly, the housing 2 includes an outer housing wall 21, and a partition unit 22 disposed in the outer housing wall 21. The partition unit 22 cooperates with the outer housing wall 21 to define an impeller chamber 23, a cooling chamber 24, a stator chamber 25 disposed around the cooling chamber 24, a mounting chamber 26 disposed under the cooling chamber 24, and a cooling passage 27 disposed between and in fluid communication with the impeller chamber 23 and the cooling chamber 24. The impeller chamber 23 and the mounting chamber 26 are located respectively to two sides of the cooling chamber 24.

The partition unit 22 includes a first partition 221 for partitioning the impeller chamber 23 and the cooling chamber 24, a second partition 222 for partitioning the cooling chamber 24 and the mounting chamber 26, and an annular partition 223 disposed between the first and second partitions 221, 222 for partitioning the cooling chamber 24 and the stator chamber 25. The first partition 221 is aligned with the housing body 201, and includes a first mounting hole 224 and a plurality of angularly equidistant first mounting blocks 225 disposed around the first mounting hole 224. The second partition 22 is aligned with the second end cap 203, and includes a second mounting hole 226 and a plurality of angularly equidistant second mounting blocks 227 disposed around the second mounting hole 226. The cooling passage 27 has a plurality of passage ports 271 each located between two adjacent first mounting blocks 225. The cooling chamber 24 has a main chamber portion 241 in fluid communication with the passage ports 271, a bottom chamber portion 242 disposed under the main chamber portion 241, and a plurality of communicating portions 243 each located between two adjacent second mounting blocks 227. The communicating portions 243 are disposed between and in fluid communication with the main chamber portion 241 and the bottom chamber portion 242.

Figure 2:
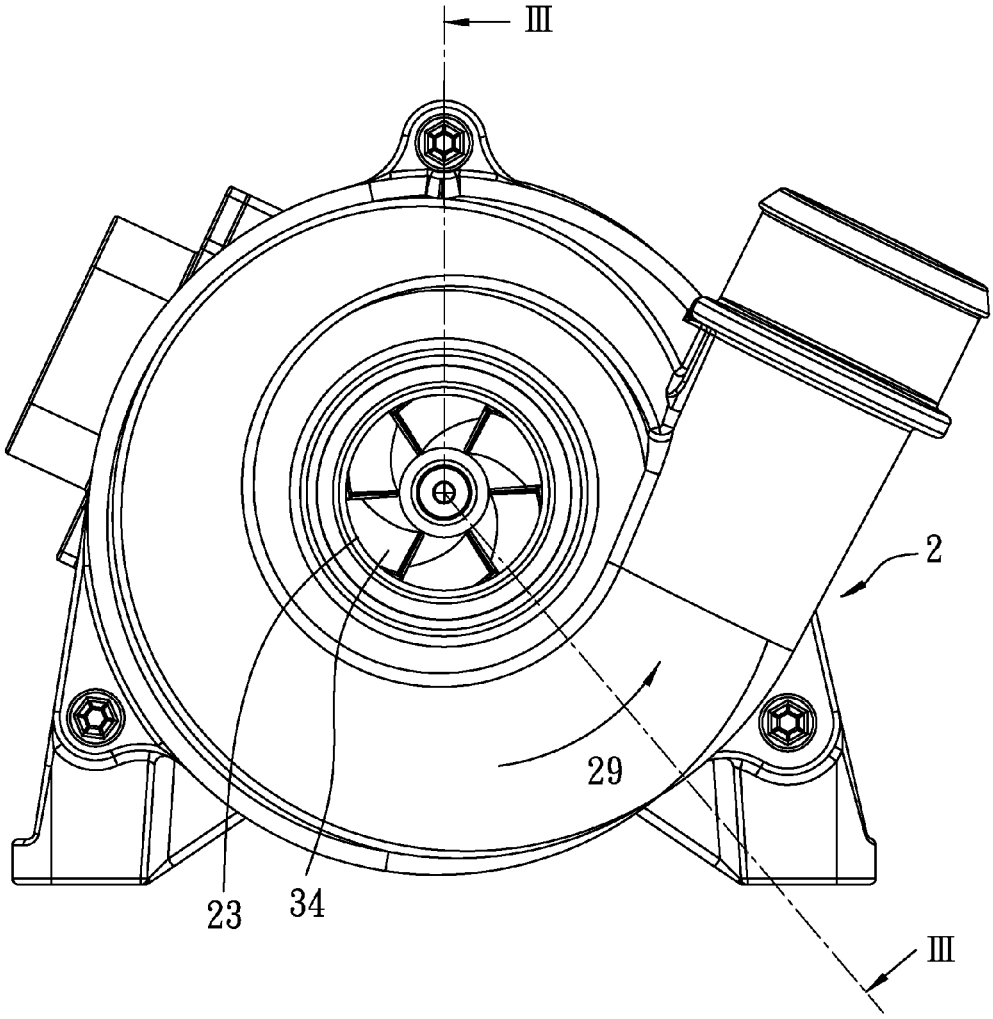
FIG. 2 is a top view of the first preferred embodiment of an electric fluid pump according to this invention.
Figure 3:
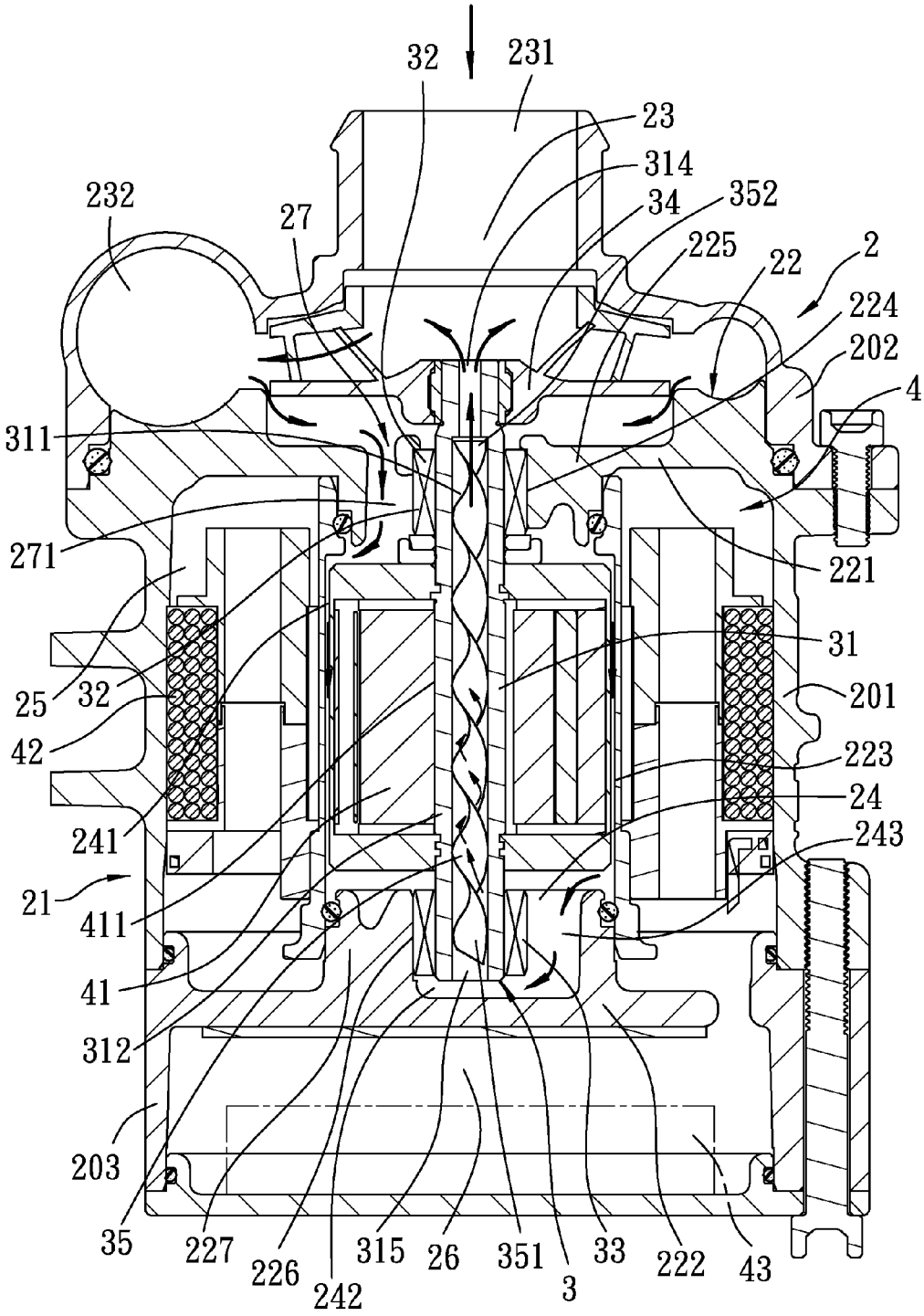
FIG. 3 is a sectional view taken along line III-III in FIG. 2.
Figure 4:
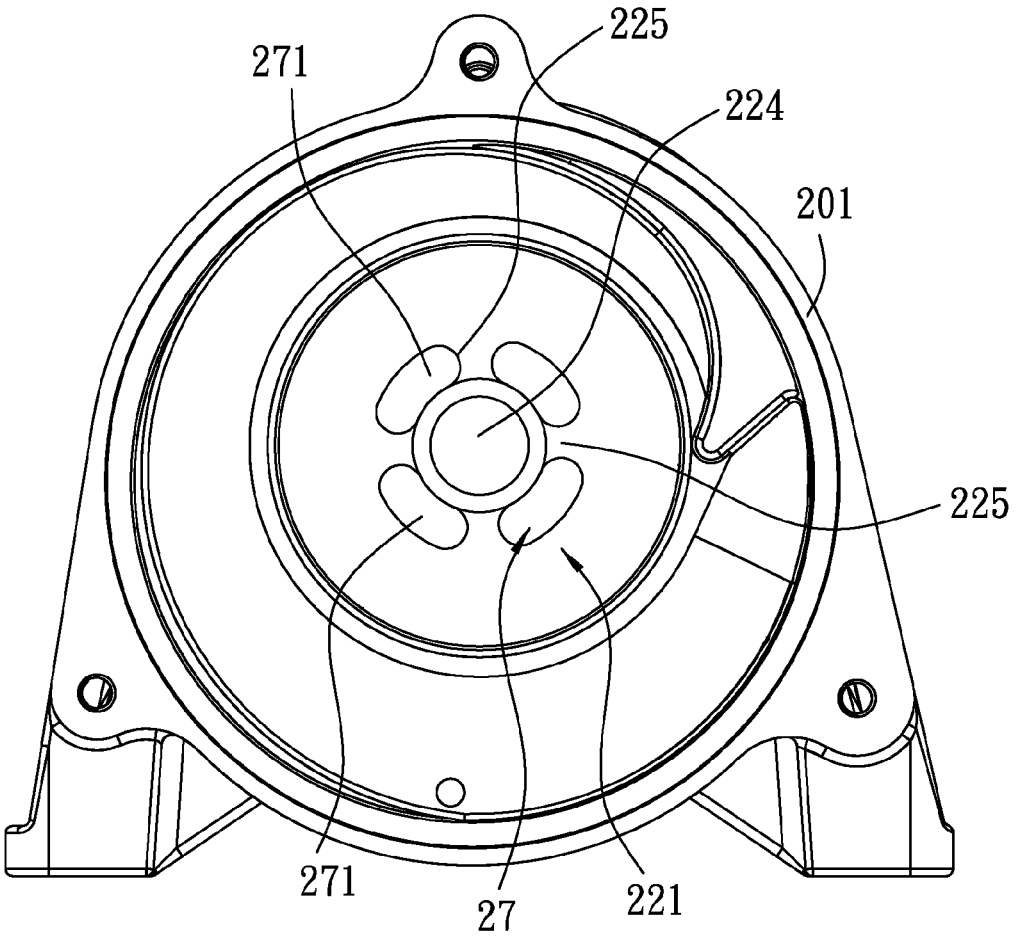
FIG. 4 is a top view of a housing body of the first preferred embodiment.
Figure 5:
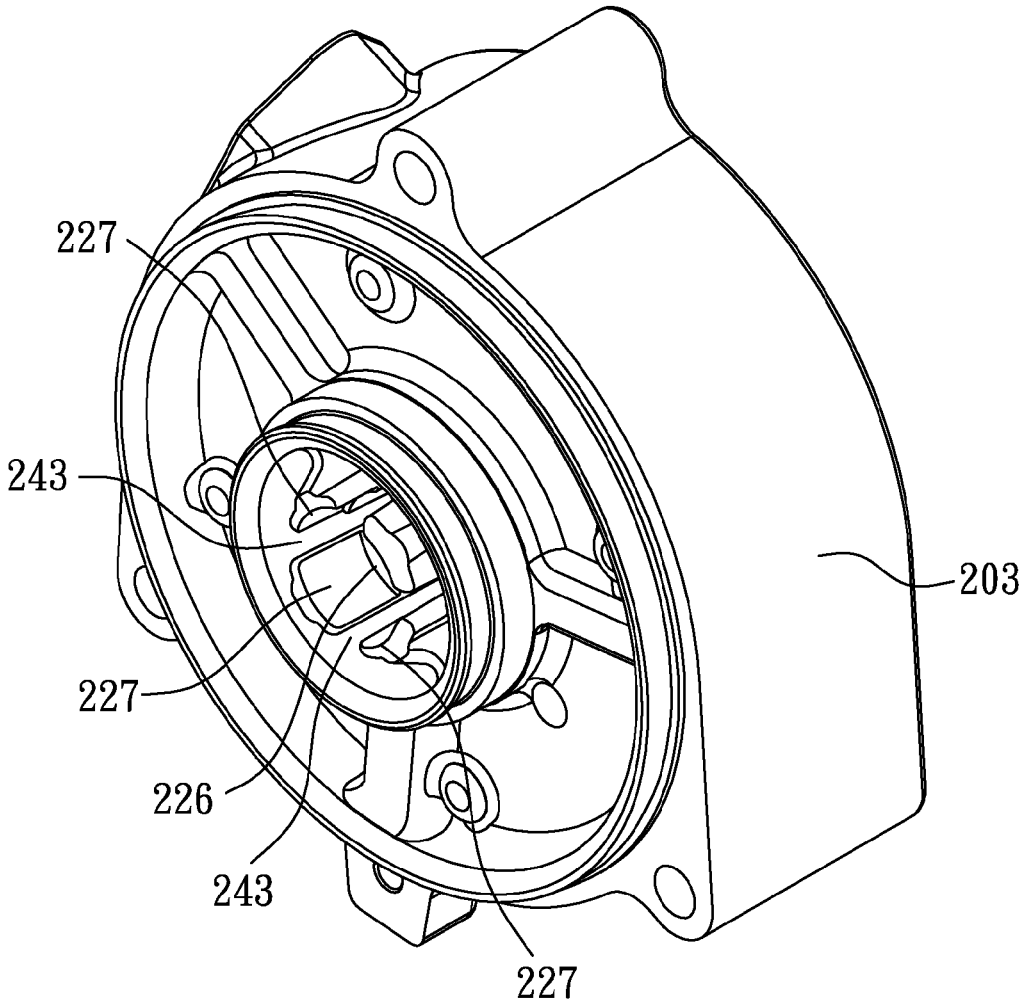
FIG. 5 is a perspective view of a second end cap of the first preferred embodiment.
Figure 6:
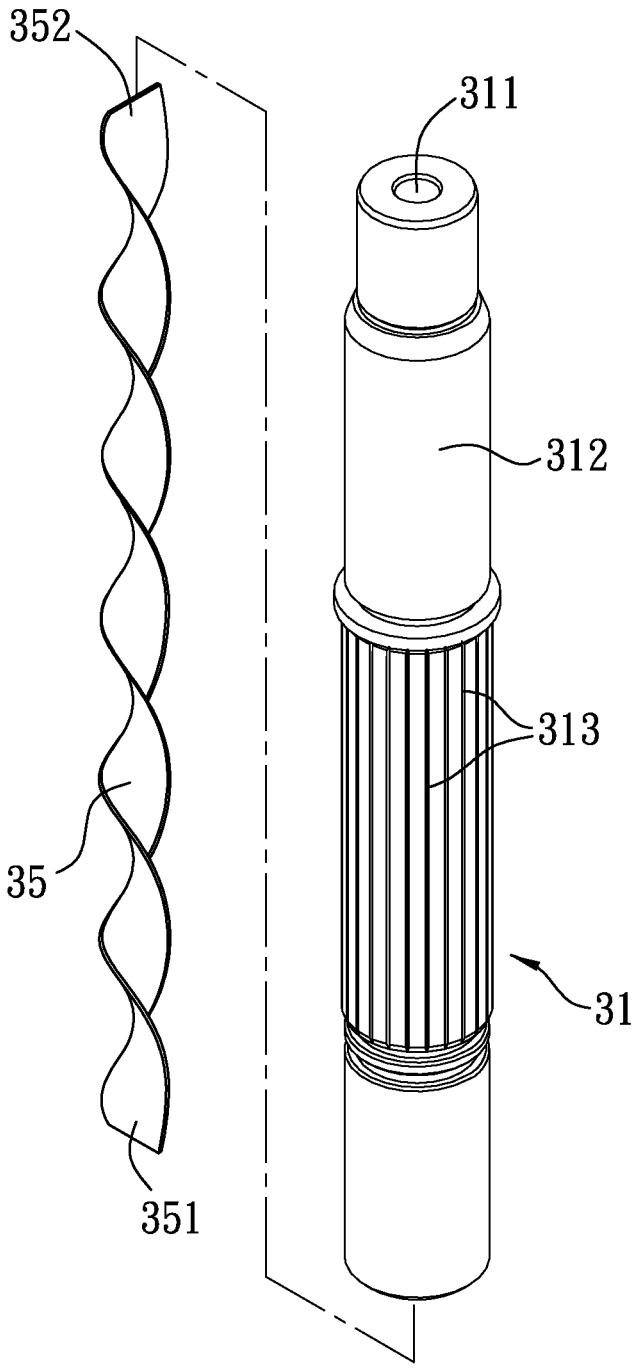
FIG. 6 is an exploded perspective view of a driving shaft and a spiral rod of the first preferred embodiment.

Referring to FIGS. 2, 3, and 6, the propelling mechanism 3 includes a driving rod 31, a first bearing 32 disposed among the first mounting blocks 225 of the first partition 221, a second bearing 33 disposed among the second mounting blocks 227 of the second partition 222, an impeller 34 connected to and co-rotatable with the driving shaft 31 and disposed in the impeller chamber 23 in the housing 2, and a spiral rod 35 disposed in the fluid passage 311 in the driving shaft 31. The impeller 34 is rotatable to force the fluid to flow into the impeller chamber 23 through an inlet 231. Hence, the fluid passes through the impeller chamber 23, and is discharged through an outlet 232.

The driving shaft 31 further has a surrounding wall 312 defining the fluid passage 311. An outer surface of the surrounding wall 312 has an externally splined portion 313. The fluid passage 311 has a first passage end 314 adjacent to a central low-pressure area of the impeller chamber 23, and a second passage end 315 adjacent to the second partition 222. The spiral rod 35 is disposed in the fluid passage 311 in the driving shaft 31 in a close fitting manner, so as to be co-rotatable with the driving shaft 31. The spiral rod 35 has a first rod end 351 adjacent to the second passage end 315 of the fluid passage 311 in the driving shaft 31, and a second rod end 352 adjacent to the first passage end 314 of the fluid passage 311 in the driving shaft 31. The spiral rod 35 has a spiral direction such that rotation of the spiral rod 35 results in flow of the fluid from the first rod end 351 to the second rod end 352.

The driving mechanism 4 includes a rotor 41 disposed in the main chamber portion 241 of the cooling chamber 24 in the housing 2, a stator 42 disposed in the stator chamber 25 in the housing 2, and an electric control unit 43 disposed in the mounting chamber 26 in the housing 2 and electrically connected to the stator 42. The rotor 41 has an internally splined central axial hole 411 permitting the driving shaft 31 to extend therethrough and engaging the externally splined portion 313 of the driving shaft 31, so as to allow co-rotation of the rotor 41 with the driving shaft 31.

During use of the electric fluid pump, the driving shaft 31 of the propelling mechanism 3 is driven by the driving mechanism 4 to rotate. Hence, the impeller 34 rotates to force the fluid to flow into the impeller chamber 23 in the housing 2 and through the impeller chamber 23 along the delivery direction 29 for discharging. During flow of the fluid in the impeller chamber 23, a minor portion of the fluid entering the impeller chamber 23 flows into the main chamber portion 241 of the cooling chamber 24 through the cooling passage 27, and subsequently into the bottom chamber portion 242 through the communicating portions 243. Since the stator 42, the rotor 41, and the electric control unit 43 are disposed in proximity to the cooling chamber 24, and since the first and second bearings 32, 33 are surrounded respectively by an assembly of the passage ports 271 and an assembly of the communicating portions 243 and thus immerged in the fluid, they can be cooled by the fluid.

During rotation of the impeller 34, since the pressure of a portion of the fluid adjacent to the central portion of the impeller 34 is smaller than that of a portion of the fluid adjacent to the circumferential portion of the impeller 34, when the fluid enters the bottom chamber portion 242 of the cooling chamber 24, it flows into the impeller chamber 23 through the fluid passage 311 in the driving shaft 31. As such, due to the pressure difference described above, the fluid returns from the cooling chamber 24 to the impeller chamber 23.

More importantly, the spiral rod 35 co-rotates with driving shaft 31 to create a propelling force to accelerate return flow of the fluid from the cooling chamber 24 to the impeller chamber 23 through the fluid passage 311 in the driving shaft 31, thereby promoting the cooling effect.

Figure 7:
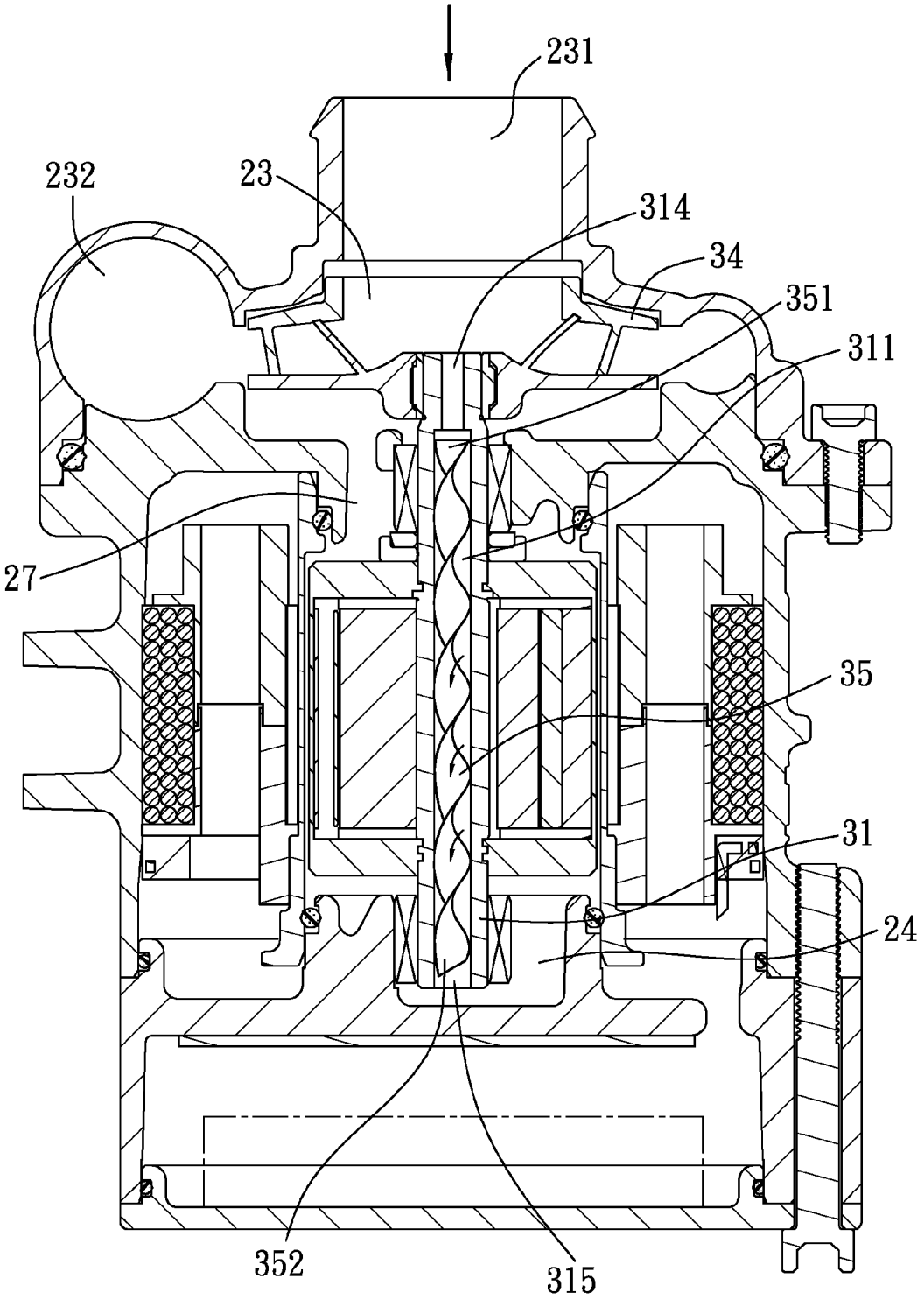
FIG. 7 is a view similar to FIG. 3 but illustrating the second preferred embodiment of an electric fluid pump according to this invention.

FIG. 7 shows a second preferred embodiment of an electric fluid pump according to this invention, which is similar to the first preferred embodiment except for a modified spiral rod 35. In this embodiment, the spiral direction of the spiral rod 35 is changed to create a propelling force that tends to drive flow of the fluid from the first passage end 314 of the fluid passage 311 in the driving shaft 31 to the second passage end 315. Due to the change of the spiral direction of the spiral rod 35, the cooling effect is reduced, and a resistance to flow of the fluid into the second passage end 315 is created, so as to increase the output fluid pressure, as described in detail in the succeeding paragraph.

During use, the major portion of the fluid entering the inlet 231 flows into the outlet 232, and the minor portion of the fluid flows through the cooling passage 27, the cooling chamber 24, and the fluid passage 311 to return to the impeller chamber 23. Since the spiral direction of the spiral rod 35 can result in a resistance to the flow of the fluid through the fluid passage 311, the rate of the fluid flowing through the fluid passage 311 and the amount of the fluid flowing into the fluid passage 311 are reduced, thereby increasing the amount of the fluid flowing from the inlet 231 to the outlet 232 and, thus, the output fluid pressure. That is, the more the resistance, the more the output fluid pressure. It should be noted that an adjustment to the spiral angle of the spiral rod 35 also can change the resistance.

Figure 8:
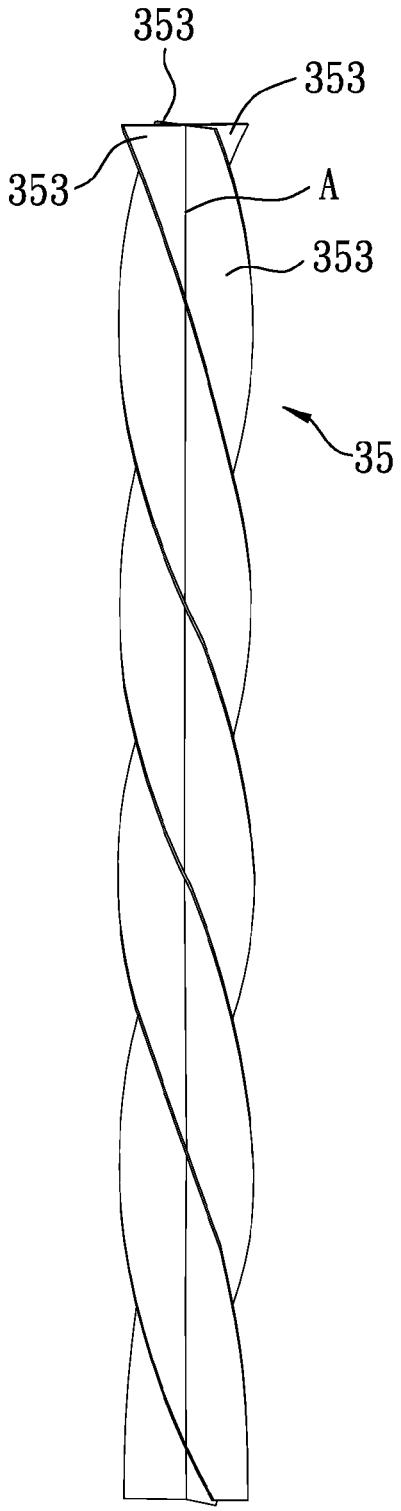
FIG. 8 is a perspective view of a spiral rod of the third preferred embodiment of an electric fluid pump according to this invention.

FIG. 8 shows another modified spiral rod 35, which has four spiral vanes 353 disposed around a central axis (A) thereof. An adjustment to the number of the spiral vanes 353 also can change the resistance.

Figure 9:
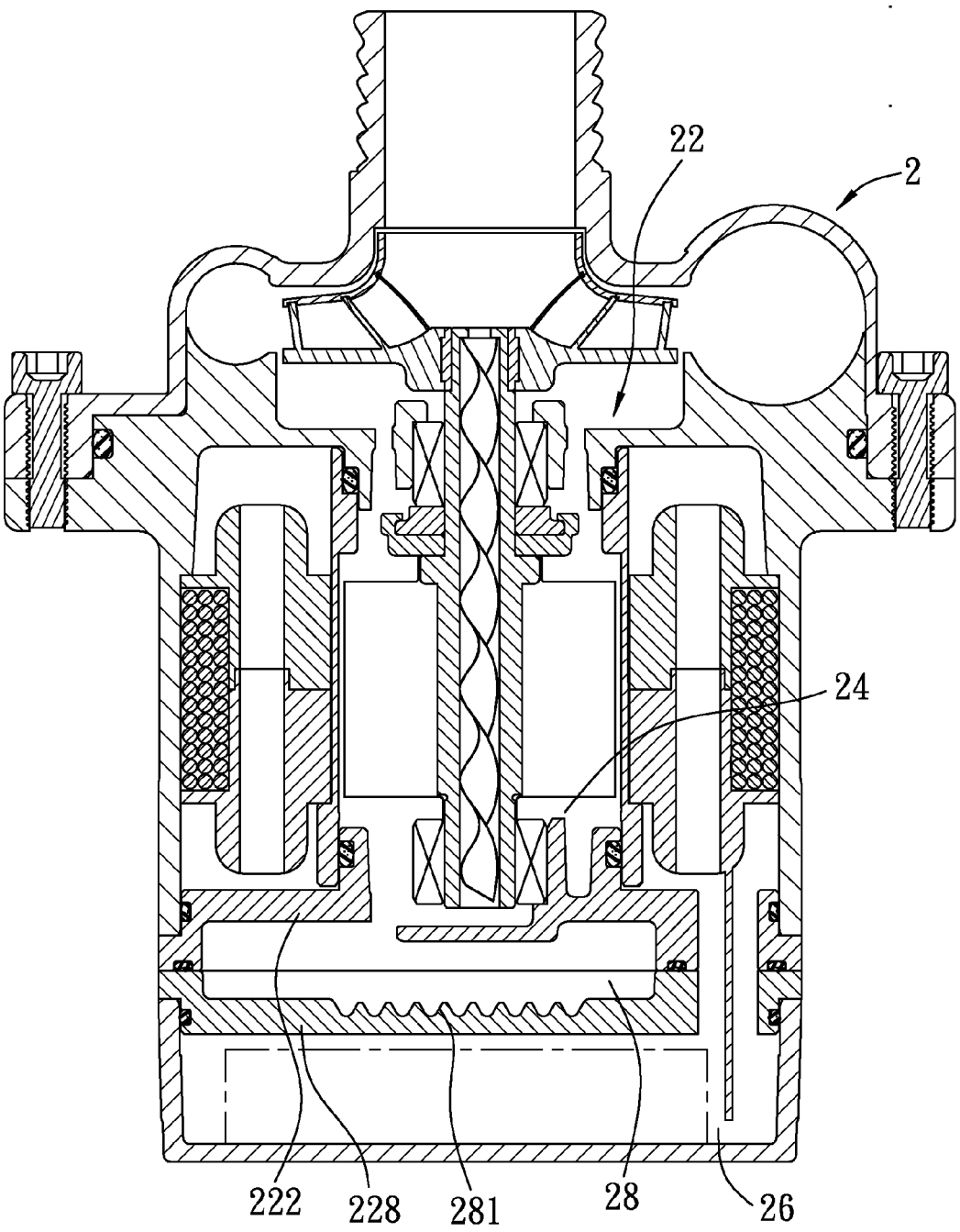
FIG. 9 is a view similar to FIG. 3 but illustrating the fourth preferred embodiment of an electric fluid pump according to this invention.

Referring to FIG. 9, in an alternative preferred embodiment, the housing 2 further includes a third partition 228. The housing 2 further includes a cooling assisting chamber 28 defined by the third partition 228 and the second partition 222 and disposed between the cooling chamber 24 and the mounting chamber 26. The third partition 228 has a convex-and-concave side surface 281 facing the cooling assisting chamber 28 to promote the heat dissipating effect.

In view of the above, by replacing the spiral rod 35, the cooling effect or the output fluid pressure can be adjusted without changing the basic structure or the specification. Thus, the object of this invention is achieved.

With this invention thus explained, it is apparent that numerous modifications and variations can be made without departing from the scope and spirit of this invention. It is therefore intended that this invention be limited only as indicated by the appended claims.

We claim:

1. An electric fluid pump comprising:

a housing including an outer housing wall and a partition unit cooperating with said outer housing wall so as to define an impeller chamber, a cooling chamber, and a cooling passage disposed between and in fluid communication with said impeller chamber and said cooling chamber;

propelling mechanism including a driving shaft disposed rotatably on said partition unit of said housing and having a fluid passage formed therethrough, an impeller disposed in said impeller chamber and connected to and co-rotatable with said driving shaft, and a spiral rod disposed in said fluid passage in said driving shaft and co-rotatable with said driving shaft, said fluid passage being disposed between and in fluid communication with said impeller chamber and said cooling chamber in said housing; and driving mechanism for driving rotation of said driving shaft of said propelling mechanism;

wherein, when said driving shaft is rotated by said driving mechanism, said impeller rotates to drive a fluid to pass through said impeller chamber along a delivery direction, and said spiral rod rotates to change the rate of the fluid flowing through said fluid passage in said driving shaft;

wherein said housing further includes a mounting chamber and a stator chamber that is disposed around said cooling chamber;

wherein said driving mechanism includes a rotor disposed in said cooling chamber in said housing, a stator disposed in said stator chamber in said housing, and an electric control unit disposed in said mounting chamber and electrically connected to said stator;

wherein said partition unit of said housing includes a first partition for partitioning said impeller chamber and said cooling chamber, a second partition for partitioning said cooling chamber and said mounting chamber, and an annular partition disposed between said first and second partitions for partitioning said cooling chamber and said stator chamber, said first partition having a first mounting hole permitting said driving shaft to extend therethrough, and a plurality of spaced-apart first mounting blocks disposed around said first mounting hole, said second partition having a second mounting hole permitting said driving shaft to extend therethrough, and a plurality of spaced-apart second mounting blocks disposed around said second mounting hole;

wherein said propelling mechanism further includes a first bearing for mounting said driving shaft among said first mounting blocks of said first partition, and a second bearing for mounting said driving shaft among said second mounting blocks of said second partition; and wherein said housing further includes a cooling assisting chamber in fluid communication with said cooling chamber and disposed between said cooling chamber and said mounting chamber, said partition unit of said housing further including a third partition for partitioning said cooling chamber and said cooling assisting chamber, said third partition having a convex-and-concave side surface facing said cooling assisting chamber.

2. The electric fluid pump as claimed in claim 1, wherein said fluid passage has a first passage end adjacent to said impeller chamber in said housing, and a second passage end adjacent to said cooling chamber in said housing, said spiral rod having a first rod end adjacent to said second passage end of said fluid passage in said driving shaft, and a second rod end adjacent to said first passage end of said fluid passage in said driving shaft so that, when said driving shaft is rotated by said driving mechanism, said spiral rod rotates to drive flow of the fluid from said second passage end of said fluid passage to said first passage end of said fluid passage.

3. The electric fluid pump as claimed in claim 1, wherein said fluid passage has a first passage end adjacent to said impeller chamber in said housing, and a second passage end adjacent to said cooling chamber in said housing, said spiral rod having a first rod end adjacent to said first passage end of said fluid passage in said driving shaft, and a second rod end adjacent to said second passage end of said fluid passage in said driving shaft such that, when said driving shaft is rotated by said driving mechanism, said spiral rod rotates to create a resistance to flow of the fluid from said second passage end of said fluid passage to said first passage end of said fluid passage.

4. The electric fluid pump as claimed in claim 1, wherein said spiral rod has a central axis and four spiral vanes disposed around said central axis.

5. The electric fluid pump as claimed in claim 1, wherein said rotor of said driving mechanism has an internally splined central axial hole formed therethrough, and said driving shaft further has a surrounding wall defining said fluid passage, said surrounding wall having an outer surface that has an externally splined portion engaging said internally splined central axial hole, so as to allow for co-rotation of said rotor with said driving shaft.

6. The electric fluid pump as claimed in claim 5, wherein said cooling passage has a plurality of passage ports each located between two adjacent ones of said first mounting blocks, said cooling chamber having a main chamber portion in fluid communication with said passage ports and permitting said rotor to be disposed therein, a bottom chamber portion, and a plurality of communicating portions each located between two adjacent ones of said second mounting blocks, said communicating portions being disposed between and in fluid communication with said main chamber portion and said bottom chamber portion.

* * * * *